US005905441A

United States Patent [19]

Klee et al.

[11] Patent Number: 5,905,441

[45] Date of Patent: May 18, 1999

[54] HAND-HELD VISUAL SIGNALING DEVICE

[76] Inventors: Edward L. Klee, 805 Patterson Rd.; Richard D. Knittel, Rte. 4, Pinckard Pike, both of Versailles, Ky. 40383

[21] Appl. No.: 08/901,605

[22] Filed: Jul. 28, 1997

Related U.S. Application Data

[ 60] Provisional application No. 60/026,902, Sep. 10, 1996.

[51] Int. Cl.[6] ..... G08B 5/00

[52] U.S. Cl. ..... 340/815.4; 340/321; 340/332; 362/72

[58] Field of Search ..... 340/815.4, 321, 340/332; 362/72, 108, 190, 191

[56] References Cited

U.S. PATENT DOCUMENTS

| | | | |
|---|---|---|---|
| 1,732,970 | 10/1929 | Jones et al. | 340/321 |
| 1,772,305 | 8/1930 | Chamberland | 340/321 |
| 2,409,957 | 10/1946 | Reynolds | 340/321 |
| 2,491,914 | 12/1949 | Anderson . | |
| 2,799,854 | 7/1957 | Barnes . | |
| 3,197,757 | 7/1965 | Porta . | |
| 3,435,412 | 3/1969 | Bohrer, Sr. . | |
| 4,042,919 | 8/1977 | Patty . | |
| 4,074,252 | 2/1978 | Keller . | |
| 4,090,186 | 5/1978 | Renner . | |
| 4,827,245 | 5/1989 | Lipman . | |
| 5,081,568 | 1/1992 | Dong et al. | 340/321 |
| 5,357,246 | 10/1994 | Wendelken, Jr. . | |
| 5,440,464 | 8/1995 | Nowlin et al. . | |
| 5,446,345 | 8/1995 | Halabi et al. | 340/321 |
| 5,446,441 | 8/1995 | Su | 340/321 |
| 5,619,182 | 4/1997 | Robb | 340/321 |
| 5,687,500 | 11/1997 | Lamparter | 362/240 |
| 5,697,695 | 12/1997 | Lin et al. | 340/321 |

OTHER PUBLICATIONS

Toshiba, "Toshiba Technical Data Sheets" (date/pgs. unknown).

*Primary Examiner*—Nina Tong
*Attorney, Agent, or Firm*—King and Schickli

[57] ABSTRACT

A visual signaling device having interspersed arrays of red/amber/green LED signal lamps and a center flashing strobe lamp. A side mounted joy-stick type toggle switch on the housing is operated by the user's thumb to provide the control of the signal lamps. One position of the joy-stick button operates an on/off switch, and the other three positions each operate one of the three color arrays. A separate strobe light switch is provided adjacent the toggle switch. The housing of the signaling device is bowl-shaped and held in the palm of the user's outwardly extended hand. A strap extending around the back of the hand provides assistance. A battery pack is recharged through a standard socket for connection through a cord and utility plug to a power source.

9 Claims, 3 Drawing Sheets

HAND-HELD VISUAL SIGNALING DEVICE

This application is a continuation of the provisional application Ser. No. 60/026,902 filed Sep. 10, 1996.

TECHNICAL FIELD

The present invention relates to signaling devices, and more particularly to a portable, hand-held visual signaling device for directing and controlling people and vehicles of air, land and water.

Hand-held pedestrian and vehicle control aids are commonly used by safety officers to direct and control traffic. The most common portable aid is simply a flashlight, or a sign-type signaling device. However, the signals from these prior art devices are often not noticed or misinterpreted by motorists resulting in general confusion and inefficiency for the officer directing and controlling traffic, as well as for the motorist. This shortcoming results in extended risk and liability for the traffic controller, as well as for the motorist, and in extreme cases accidents do happen causing injury, and even deaths.

In response to these restrictions, and other limitations inherent in the commonly used flashlights, there have been several attempts to design an operationally, as well as commercially, successful hand-held traffic control signal. One draw back seems to have been that these hand-held traffic control signaling devices attempt to maintain the desirable features of flashlights, such as providing the light for the signaling device, or removed for use as a flashlight itself, while being manipulatable with one hand. This approach is disclosed in U.S. Pat. No. 4,042,919 to Patty. An illuminated sign includes a perimeter frame wall supporting a translucent sign panel that carries the word message, such as "Stop." A standard flashlight with a threaded annular cap is attached to the frame so it can be easily removed. A separate strobe light and push button control switch are situated at the top of the sign. This particular hand-held traffic control signal device is relatively large and heavy, requires two-hand operation, and is thus cumbersome for the officer to use and store. Another shortcoming is the relative high cost that prevents it from being commercially successful.

Another prevalent approach has been a lantern type, such as the traffic control signal device disclosed in U.S. Pat. No. 2,799,854 to Barnes. A rectangular housing includes three different colored lens, each with its own light source. Each light is individually controlled by separate push buttons vertically situated on one side. Additionally, the officer or other user holds the casing in one hand, but it must be in a posture such that the fingers are in position to operate the push buttons. It takes a physically large hand to hold and operate this device, leaving it a problem for male officers with small hands, or more frequently female officers, to use. The weight of these lantern type devices is a problem, as well as the relatively high initial cost, just like the flashlight-type devices described above.

As the world shrinks and becomes more homogeneous, the use of internationally recognizable signals becomes more important. Signals of green (go), yellow (caution), and red (stop) are now internationally used and accepted. Also, people walking from one point to another, and persons operating a variety of vehicles, are becoming more dependent on a non-verbal mode (visuals) for following directions from enforcement officers. The following are examples justifying the need for an improved visual signaling device.

As the population grows, public events draw attendance ranging from 60,000 to 100,000 and up, making the problem of controlling pedestrian and vehicle traffic even more acute. This proposition covers a variety of events; national basketball tournaments, professional football and basketball events, concerts, presidential inaugurations, marches and parades. These masses of people must be directed in a safe, effective, and efficient manner to and away from the event. There are different modes of transportation involved, making it even more imperative for everyone to see and understand the signals of the enforcement officer. Events of this nature also occur routinely on a smaller scale in every community, town, and city where efficient control, while not on the same scale, is still so very important.

As more and more people have time for recreation, ski boats, personal watercraft, fishing boats, pontoon boats and other watercraft are proliferating. Water recreation of this type is a fun and relaxing way to enjoy the waters in the oceans, rivers, streams and lakes. There are general rules governing the use of watercraft enforced by waterway officers that have similar enforcement powers as officers on land. Environmental conditions, including the broad spans of space, motor noise, and limited visibility, makes it even more difficult for these officers to communicate with the individual operators of watercraft. Limited state, federal and local funds have also reduced the number of waterway officers that are available for duty at any one time. To add to the burden, these watercraft also operate at dusk and at night. Thus, there is an increasing need for efficient visual communication between officer and the operator in this environment, just as in the other environments described above.

In addition, a variety of businesses use the waterways as a means for profit. From tour boats for hire to fishing boats, and from cruise ships to fishing exhibition boats and from barge and tug to ocean going freight vessels, communicating with one another is very important. There are times when only a visual means of communicating is available. For example, emergencies while operating at night, during storms, in fog and in congested areas, demand a way of efficient visual signaling.

Similarly, a variety of aircraft are affected and need a means for visual communication through the use of a signaling device. These incidences are primarily in slow moving, relatively small craft, such as powered and hang gliders and hot air balloons. Persons responsible for directing these aircraft, especially where a large number are concentrated in a relatively small space, such as at a rally, need a visual signaling control device, in addition to whatever audible communication is used. Noise of the aircraft, as well as long distances, and even the relative large size in case of balloons, tends to limit audible communication making the need for an easy to use and universally recognizable signaling device a necessity here also.

Another very important factor to consider is that persons responsible for so directing the people and the vehicles are responsible for completing this task in a safe manner. The signal control device helps in accomplishing this result, and in turn in reducing this liability. Personal, as well as vehicular accidents related to human error of the person responsible for their safety and control, are increasing with the increased numbers and concentrations that are prevalent today. Not only the individual, but also the municipal (or the like) employer, become liable for these errors. This factor adds still further impetus to finding an efficient and cost effective way to provide control signals from one person to another, with or without a vehicle being involved.

Thus, there is a need identified for a portable, hand-held visual signaling device that provides the universally recognized red, green and amber (yellow) signal lights, and is efficient in operation, as well as being relatively low cost so that it can be widely used by enforcement officers, and others responsible for personal safety. In one form, it should be packaged in a compact and lightweight housing assembly and designed to fit comfortably in the palm of a hand in the natural command position. It should be applicable to directing and controlling people and vehicles of air, land and water. Its commands should be easy to understand and highly visible under all environmental conditions.

SUMMARY OF THE INVENTION

Thus, a primary object of this invention is to provide an improved hand-held visual signaling device for use by a person responsible for directing people and vehicles of air, land and water.

Another object is to provide a visual signaling device wherein the housing is of a generally dish or bowl shape designed to fit comfortably in the palm of a hand in the natural command position for a person responsible for directing and controlling people.

It is another object of the invention to provide a compact, easy to hold and operate visual signaling device.

A related object is to provide such a device having a joy stick type control switch positioned to be easily manipulated by the user.

Another object is to provide a signaling device that is small and lightweight to be easily used by male and female officers alike, and is easy to store for quick access when needed.

Another and related object is to provide at least one red, at least one green and at least one amber light source arranged behind a single lens to minimize the overall size and weight of the assembly, and to utilize the universally recognized color traffic control signals.

It is still another object of the present invention to provide a hand-held visual signaling device of the type described, and having a center strobe light as an additional attention command and focus for alerting, directing and controlling the people and vehicles, as desired.

To achieve the foregoing and other objectives, and in accordance with the purposes of the present invention as described herein, a novel hand-held visual signaling device for directing and controlling persons and vehicular traffic is provided. The signaling device adds to the safety for the person(s) controlled, as well as those responsible for the directing and controlling function. It applies to people as pedestrians as well as operators of vehicles on the land or water, and in the air.

The portable visual signaling device includes a generally dish or bowl-shaped housing that fits comfortably in the palm of a hand in the natural command position of an enforcement officer or other person responsible for directing and controlling the people. A wrap around strap secures the signaling device to the user's hand.

The hand-held visual signaling device advantageously includes at least one red, at least one green and at least one amber light source in an array behind a single lens. A joy stick switch makes control very easy and a center strobe increases the attention and focus of the person being controlled. The entire device is housed within the generally bowl-shaped housing.

Preferably, multiple red, green and amber signal lamp arrays make-up the light sources in the signaling device. The lamps are preferably LED lamps suitable for outside use. The red, green and amber arrays of lamps are interspersed with each other. Thus, when one array is activated to provide the desired color signal from the face of the housing, a bright, easy to see and interpret visual signal is available. Preferably, the lamps are placed on a circuit board which is mounted to the inside of the housing and positioned to project a signal toward and through the single lens covering the face of the housing. The circuit board and array of lamps receive power from a rechargeable power supply positioned between the inside of the housing and the circuit board.

The center strobe lamp is provided in the center of the signaling device and also mounted on the circuit board. Its flashing action right in the center of the colored visual signal adds a significant factor for attention command and focus to provide an extra margin of safety for both the person being controlled, as well as the one responsible for doing the directing and controlling.

The colored arrays of signal lamps and the strobe lamp are enclosed within the housing by a circular dispersing lens, which is secured on the inner wall of the housing. The lens disperses the colored light making it easy for interpreting the conveyed message of stop, go or caution. The enclosure by the lens provides protection to the internal components of the signaling device from potentially harmful contact with foreign objects and from the environmental elements, such as rain or snow.

The joy-stick type toggle switch is provided on the side of the housing in position for easy contact by the thumb of the user. The toggle control action holds the switch in an on-off position, or in the red, amber and green signal positions, until another position is pressed. In this way the switch does not have to be held down in the on position. The joy-stick toggle switch advantageously replaces four separate switches that would otherwise be required.

Similarly, a push button switch is provided on the side of the housing to activate the center strobe light, and is advantageously positioned in close proximity to the LED lamp control toggle switch for ease of operation when necessary.

A charging socket is also provided on the housing to provide power to the rechargeable power supply. The charging socket accepts a standard input jack connected through an extension cord to a standard cigarette/utility plug, or other suitable source of power.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrates several aspects of the present invention and together with the description serves to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
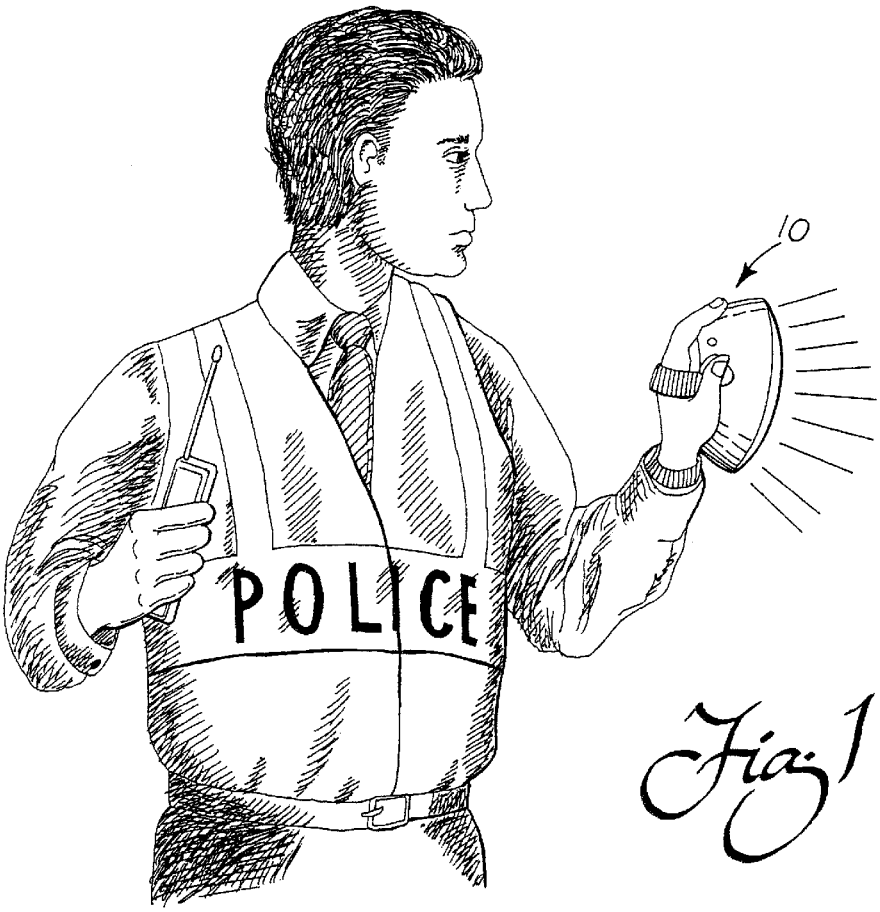
FIG. 1 is an illustration of an enforcement officer holding the signaling device of the present invention in the palm of the hand in the natural command position.

Reference is now made to the drawings showing the preferred embodiment of a hand-held visual signaling device according to the present invention, and generally represented by the reference number 10. As best shown in FIG. 1, the signaling device 10 is particularly adapted for portability and is compact to it comfortably in the palm of the right or left hand in the natural command position for a person responsible for directing and controlling people and vehicles of air, land and water.

In the preferred embodiment, a round dish/bowl shaped housing, represented by the reference number 11, best accomplishes the objective to fit comfortably in the palm of a hand. A holding device, such as a strap 15, secures the hand to the housing 11.

Figure 2:
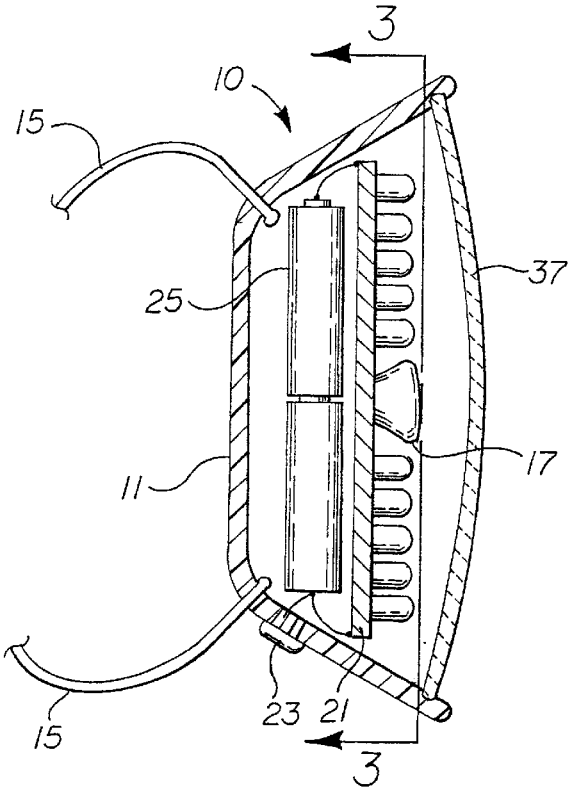
FIG. 2 is a cross-sectioned view of the signaling device illustrating the array of signaling lamps, the strobe lamp, the circuit board, the input power socket, the battery pack and the holding strap.

As illustrated in FIG. 2, a circuit board 21 is fixedly supported by the housing 11. An array of at least one red LED lamp 31, at least one amber LED lamp 29 and at least one green LED lamp 19 is fixedly supported by the circuit board 21 to provide an optimal intensity of illumination within the desired hand-held size limitations. The LED lamps are of the outdoor type, and may be, for example, Toshiba LED lamps TLSH180P, TLYH180P and TLGA183P, respectively. Additionally, a strobe light 17 is fixedly supported at the center of the circuit board 21.

Figure 3:
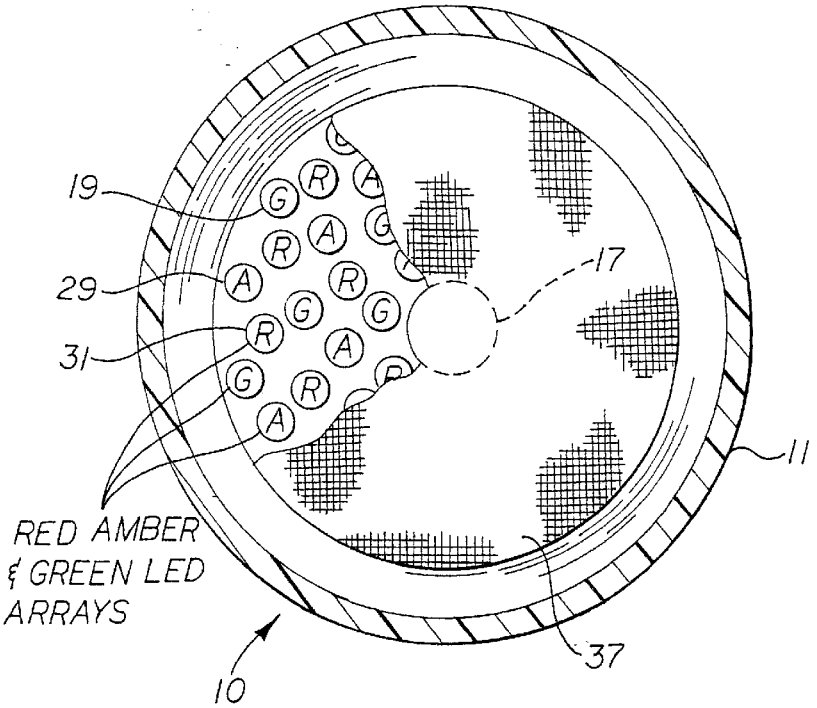
FIG. 3 is a front view of the signaling device with the single lens broken away to show the three arrays of colored LED lamps.

A clear plastic lens 37 is fixedly supported along the inner wall of the housing 11 (see FIG. 3). The lens 37 disperses the selected signal evenly.

Figure 5:
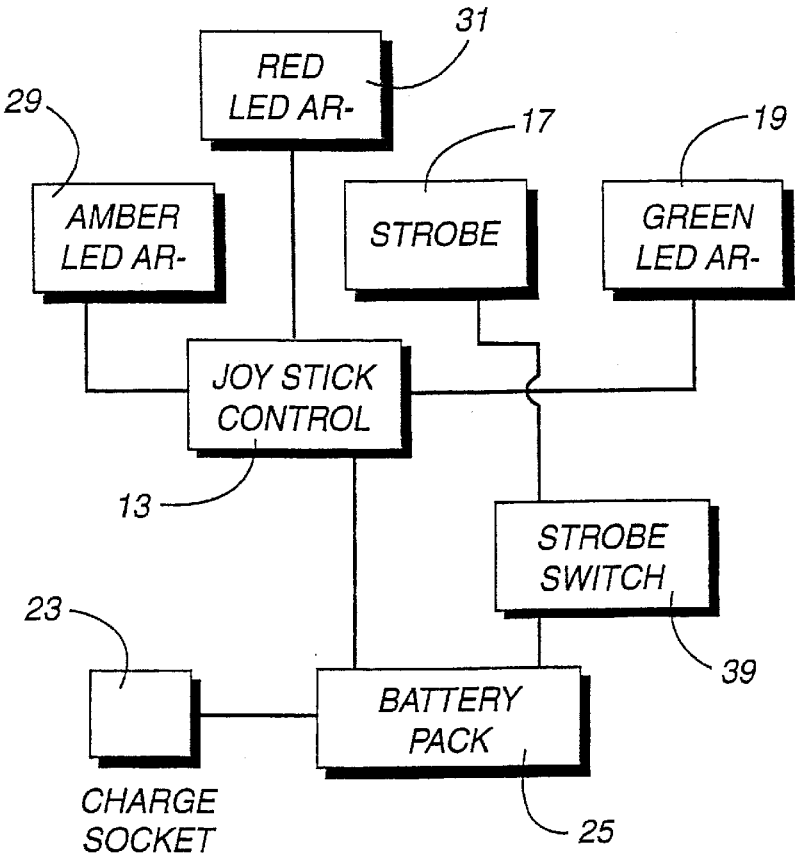
FIG. 5 is a schematic diagram of the control circuit of the signaling device.

As schematically represented in FIG. 5, a rechargeable battery pack 25 provides power to joy-stick type toggle switch 13 and the strobe push-button switch 39. The toggle switch 13 is a four position switch with the positions representing in sequence off/on red, amber or green signals, and operating to hold each position until another position of the switch is activated. Power from the battery pack 25 is selectively switched in parallel through the circuit board to either an array of red LED lamps wired in series or parallel, an array of amber LED lamps wired in series or parallel, or an array of green LED lamps wired in series or parallel and interspersed with each other (see FIG. 3).

The toggle switch 13 in the off position creates an open circuit and power for all of the LED lamps is interrupted. Additionally, the strobe light switch 39 is a two position push-pull-type switch controlling power from the circuit board 21 to the strobe light 17. With the strobe light switch in the on position, power from the battery pack 25 is selectively provided through the circuit board 21 to the strobe light 17 to provide a high intensity flashing signal. Of course, the switch 39 in the off position creates an open circuit and the power for the strobe light 17 is interrupted.

A socket is supported by the housing 11 and provides the rechargeable battery pack 25 access to an external power source. An input jack connected through a cord to a cigarette/utility plug is utilized for this purpose.

Figure 4:
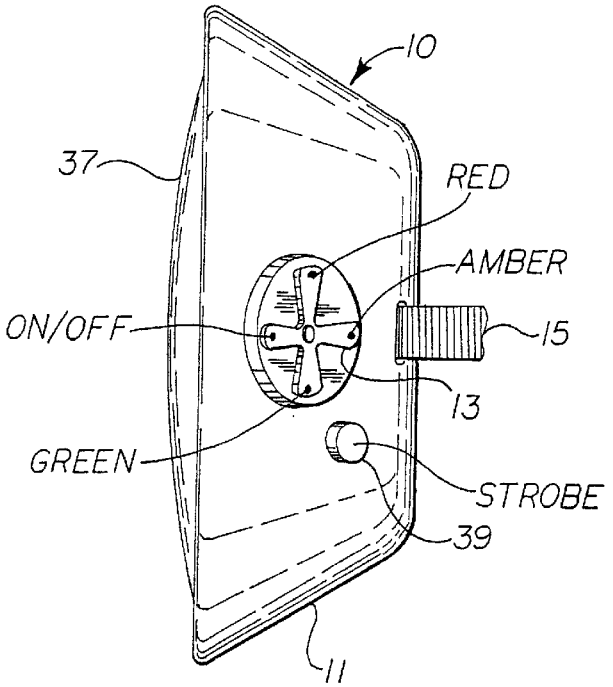
FIG. 4 is a side view to illustrate the four-way joy-stick switch and strobe switch on the side.

As best seen in FIG. 4, the joy-stick type toggle switch 13 is fixedly supported on the side of the housing 11 in a position to be easily operable by the thumb while the signaling device 10 rests comfortably in the palm of the hand. Similarly, the strobe light switch 39 is fixedly supported on the side of the housing 11 and is positioned to be easily operable by the user.

From the foregoing description, it can be seen that substantial improved results are obtained with the signaling device 10 of the present invention. The generally rounded and compact bowl-shaped housing 11 allows the device to be held comfortably in the palm of the hand in the natural command position of the officer, or other person, for efficient operation. Three arrays of LED lamps 31, 29 and 19 interspersed with each other behind a single lens 37 are selectively operated to direct persons, such as pedestrians, vehicle operators or the like. A center strobe lamp 17 commands and focuses the attention of the person being directed. A joy-stick type (4-way) toggle switch 13 and push button switch 39 controls the various light functions in an efficient manner providing exceptional ease of operation.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

We claim:

1. A hand-held visual signaling device for at least two different commands comprising:

a generally rounded housing for fitting and holding in the palm of a hand;

a circuit supported relative said housing;

an array of at least two different colored signal lamps corresponding to said two different commands supported relative said housing;

a battery for supplying power to said lamps through said circuit; and at least one switch on said housing for operation by the hand for controlling said lamps;

said signal lamps being multiple light emitting diodes of each color to form interspersed arrays relative to each other to provide the command signals, whereby the device can be held comfortably in the palm of the hand in a natural command position and efficiently operated to provide the commands.

2. The signaling device of claim 1, wherein said housing is generally bowl-shaped to fit the palm of the hand.

3. The signaling device of claim 1, wherein said light emitting diodes are of red, amber and green color positioned in said housing behind a single lens.

4. The signaling device of claim 3, wherein is further provided a strobe lamp in the center of said arrays to generate a high intensity flashing light to command attention and focus for warning of the signaling device.

5. The signaling device of claim 4, wherein is provided a joy-stick type toggle switch on said housing to provide four-way operation, including on-off, red, amber or green lamp array operation.

6. The signaling device of claim 5, wherein is provided a separate switch adjacent said toggle switch to operate said strobe lamp.

7. A hand-held visual signaling device for at least two different commands comprising:

a housing for holding in the hand;

a circuit supported relative said housing;

an array of at least two different colored signal lamps corresponding to said two different commands supported relative said housing;

a strobe lamp in the center of said arrays to generate a high intensity flashing light to command attention and focus for warning of the signaling device;

a battery for supplying power to said lamps and said strobe lamp through said circuit; and a joy-stick type toggle switch on said housing to provide four-way operation, including on-off, and selective colored lamp operation to provide command signals.

8. The signaling device of claim 7, wherein the colored lamps are light emitting diodes of red, amber and green color positioned in said housing behind a single lens.

9. A hand-held visual signaling device for at least two different commands comprising:

a housing for holding in the hand;

a circuit supported relative said housing;

an array of at least two different colored signal lamps corresponding to said two different commands supported relative said housing;

a strobe lamp in the center of said arrays to generate a high intensity flashing light to command attention and focus for warming of the signaling device, a battery for supplying power to said lamps and said strobe lamp through said circuit;

said multiple arrays of colored signal lamps being interspersed with each other to provide the command signals; and said lamps being light emitting diodes of red, amber and green color positioned in said housing.

* * * * *

UNITED STATES PATENT AND TRADEMARK OFFICE

CERTIFICATE OF CORRECTION

PATENT NO : 5,905,441

DATED : May 18, 1999

INVENTOR(S) : Edward L. Klee and Richard D. Knittel

It is certified that error appears in the above-identified patent and that said Letters Patent is hereby corrected as shown below:

Col. 8, line 13
replace "warming"
with -- warning--.

Signed and Sealed this

Seventh Day of December, 1999

*Attest:*

Q. TODD DICKINSON

*Attesting Officer*

*Acting Commissioner of Patents and Trademarks*